US005351637A

United States Patent [19]

Brenckmann

[11] Patent Number: 5,351,637

[45] Date of Patent: Oct. 4, 1994

[54] INFLATABLE SAILBOARD

[76] Inventor: Michele Brenckmann, 3360 Paul Anka Dr., #610, Ottawa, Ontario, Canada, K1V 9S2

[21] Appl. No.: 949,641

[22] PCT Filed: Apr. 24, 1992

[86] PCT No.: PCT/CA92/00174

§ 371 Date: Dec. 7, 1992

§ 102(e) Date: Dec. 7, 1992

[87] PCT Pub. No.: WO92/19491

PCT Pub. Date: Nov. 12, 1992

[30] Foreign Application Priority Data

Apr. 24, 1991 [GB] United Kingdom ..... 9108768.4

[51] Int. Cl.[5] ..... B63B 35/79

[52] U.S. Cl. ..... 114/39.2; 114/50; 441/66

[58] Field of Search ..... 114/39.2, 345, 347, 114/90; 441/66, 74, 40

[56] References Cited

U.S. PATENT DOCUMENTS

| | | | |
|---|---|---|---|
| 3,577,576 | 4/1971 | Lobb et al. | 9/2 A |
| 4,194,458 | 3/1980 | Messing | 114/90 X |
| 4,253,209 | 3/1981 | Carn | 9/310 E |
| 4,926,772 | 5/1990 | Bright | 114/39.2 |

FOREIGN PATENT DOCUMENTS

| | | | |
|---|---|---|---|
| 2742989 | 4/1979 | Fed. Rep. of Germany . | |
| 3143769 | 5/1983 | Fed. Rep. of Germany | 441/74 |
| 8700198 | 2/1987 | Fed. Rep. of Germany . | |
| 2337566 | 8/1977 | France . | |
| 2365478 | 4/1978 | France . | |
| 1545124 | 5/1979 | United Kingdom | B63H 9/10 |
| 2171963 | 9/1986 | United Kingdom | 114/39.2 |

*Primary Examiner*—Sherman Basinger
*Attorney, Agent, or Firm*—Martin S. Marcus

[57] ABSTRACT

A novel stable inflatable or inflated sail board is provided. The sailboard includes a plurality of discrete, gas-fillable or gas-filled, elongated chambers, each chamber having a top skin and a bottom skin, each chamber, when inflated being sufficiently rigid to maintain its shape without any additional support, and to provide a flat bottom surface for contact with water, the chambers being integrally united to provide an elongated float which is of greater length than width. The sailboard also includes a supporting and stiffening rigid frame comprising a plurality of frame sections which are interconnectable with each other in a longitudinal direction, the frame supporting the floatation member and providing additional stiffness and resistance to fore-and-aft bending and torsion. Finally, the board includes a rigid platform, which is of the same width as the floatation member but which is of less length, the rigid platform being firmly held to the top skin and being directly and rigidly connected to the rigid frame. The gas-filled chambers, the rigid frame and the rigid platform together provide an integral unitary assembly which imparts additional rigidity to the flat bottom surface of the floatation member and also imparts stiffness in a transverse direction to the floatation members.

4 Claims, 3 Drawing Sheets

INFLATABLE SAILBOARD

BACKGROUND OF THE INVENTION (i) Field of the Invention

The invention relates to the classes of objects known as sailboards and inflatable water craft. In particular, it is scaled to meet the needs of children, ages eight to twelve years. It is also a multipurpose water craft, as it can be used with or without it's sail, for different purposes. The invention is demountable, portable and storable in a confined space.

(ii) Description of the Prior Art

Children currently use adult sailboards to learn to sailboard. These boards are difficult for them to handle in the water, during transportation, and for storage, being both heavy (more than 40 lb/18.2 kg), and long (over 11 feet/365 cm). A beginner board requires high floatation (over 200 liters), and current boards achieve this through material and length. The described invention reduces the weight and the length, while maintaining the required floatation, by the use of inflation. In addition, the use of inflation in the design adds the attributes of the board being collapsible into manageable pieces, and storable in confined spaces.

The following are quantitative considerations for the design of a sailboard using a stiffened inflatable structure.

Three main considerations govern the design of sailboards—buoyancy, weight and stiffness.

With respect to buoyancy, sailboard has to have buoyancy to support the total operating weight (weight of the user plus weight of the board with all its gear). Buoyancy is obtained as a function of the board's total volume V, as follows:

$$V = \text{factor} \times L \times B \times T = \text{about } 2 \times \frac{\text{total operating weight}}{\text{water specific weight}}$$

where

L=board length;

T=board thickness

B=board breadth;

factor=depending on shape.

For an adult beginner's board, total operating weight is usually around 125 Kg. Typical board volume is therefore about 250 liters.

For a child's board (8 to 12 years old child) total operating weight can be reduced to about 85 Kg and the board's volume can be kept to 170 liters.

With respect to board weight, the lighter the board, the easier it is to handle, both on land and in the water, and the less is its contribution to total operative weight and required buoyancy. Weight is a function of volume and density, as follows:

$W = V \times D_{av}$ $D_{av}$=function of various $D_{comp}$ where

W=board weight;

$D_{av}$=average board density $D_{comp}$=board component density

In conventional board design (foam core, reinforced skin) average density can be approximated as:

$$D_{av} = \frac{2T_s}{T} D_s + D_c$$

where $T_S$=skin thickness;

$D_S$=skin density;

$D_c$=core density.

Typically $D_{ao}$ can attain values as low as 1/10 water density, and corresponding board weight is W=250 1/10=25 Kg.

In a stiffened inflatable board design, as proposed in this invention, average density can be approximated as:

$$D_{av} = \frac{2T_i}{T} D_i + \frac{L_p}{L} \frac{T_p}{T} D_p + \frac{L - L_p}{L} \frac{A_T}{TB} D_T$$

where:

$T_i$=inflatable wall thickness $D_i$=inflatable wall density $L_p$=length of platform $T_p$=wall thickness of platform $D_p$=density of platform $A_T$=cross-section of stiffening tubes $D_T$=density of stiffening tubes Because of the design choices offered in such a design (low weight of inflatable, limited size of platform, tailored stiffening structure), $D_{av}$ can be further reduced to values as low as 1/20 water density. In the case of the child's board, this results in a boardweight of:

W=170 1/20=8.5 Kg.

With respect to stiffness, the board is subjected to forces which require structural strength and stiffness:

a) locally, to resist footprint pressures and mast and daggerboard reactions b) generally, to resist hydrodynamic forces and retain streamline shape.

Local forces are accommodated by structural design of the specific components, such as mast foot, daggerboard well, etc., both in conventional designs and in the proposed inflatable stiffened design. In the latter, these features are part of the platform design, made more efficient by the use of structural foam plastic.

General board stiffness can be characterized in a simplified analysis by considering longitudinal (bow to stern) bending stiffness. A convenient, non-dimensional indicator can be defined as:

$$\text{Stiffness to weight ratio} = \frac{S\,L}{4\,W}$$

$$\text{where } S = \frac{\text{Concentrated load on center of board}}{\text{Deflection of board supported at its tips}}$$

Typical conventional boards achieve S values of 500 N/cm, or a stiffness to weight ratio of 200.

SUMMARY OF THE INVENTION

(i) Aims of the Invention

A principal object of the present invention is to provide an inflatable sailboard having an S value of 350 N/cm, appropriate to its light duty requirement which corresponds to a stiffness to weight ratio of 250.

Another object of this invention is to provide a stiffened inflatable structure, having low weight as well as the required buoyancy and stiffness.

(ii) Statements of Invention

This invention provides a collapsible, inflatable or inflated, rigid floatation board comprising: (i) a floatation member comprising a plurality of discrete, gas-fillable or gas-filled, elongated chambers, each chamber having a top skin and a bottom skin, each chamber, when inflated, being sufficiently rigid to maintain its shape without any additional support, and to provide a flat bottom surface for contact with water, the chambers being integrally united to provide an elongated float which is of greater length than width; (ii) a longitudinally-extending, supporting and stiffening rigid frame comprising a plurality of frame sections which are interconnectable with each other in a longitudinal direction, the rigid frame being adapted to support the floatation member and to provide additional stiffness and resistance to fore-and-aft bending and torsion; and (iii) a rigid platform, which is of the same width as the floatation member but which is of less length, the rigid platform being firmly held to the top skin of the floatation member and being directly and rigidly connected to the rigid longitudinal frame; whereby the gas-fillable floatation chambers, when they are gas-filled, the rigid frame and the rigid platform together provide an integral unitary assembly which imparts additional rigidity to the flat bottom surface of the floatation member and imparts stiffness in a transverse direction to the gas-filled floatation member.

This invention also provides an inflatable or inflated sailboard comprising the combination of: (A) a floating portion comprising: (i) a floatation member comprising a plurality of discrete, gas-fillable or gas-filled, elongated chambers, each chamber having a top skin and a bottom skin, each chamber, when inflated, being sufficiently rigid to maintain its shape without any additional support, and to provide a flat bottom for contact with water, the chambers being integrally united to provide an elongated float which is of greater length than width; (ii) a longitudinally-extending, supporting and stiffening rigid frame comprising a plurality of frame section which are interconnected in a longitudinal direction, the rigid frame thereby supporting the floatation member and providing additional stiffness and resistance to fore-and-aft bending and torsion; (iii) a rigid platform, which is of the same width as the floatation member but which is of less length, the rigid platform being firmly held to the top skin of the floatation member and being directly and rigidly connected to the rigid longitudinal frame; (iv) a skeg secured to the stern end of the frame; and (v) a removable center board keel supported by the platform; and (B) a mast and sail unit comprising a mast including a plurality of interlocking mast sections, a wishbone boom a sail, means for attaching the sail to the mast, and a universal joint secured to the platform for attaching the mast to the platform; whereby the assembly of the gas-filled floatation member, the rigid frame and the rigid platform together provide an integral rigid unit which imparts additional rigidity to the floatation member and imparts stiffness in a transverse direction to the gas-filled floatation member, the assembly further having longitudinal torsional strength wherein there is direct and rigid transmission of forces evenly and rigidly from the water, through the integral rigid unit, to the user.

(iii) Other Features of the Invention

In one feature of the collapsible, inflatable or inflated floatation board of this invention, the frame is a peripheral frame comprising a plurality of interconnected tubular members, and the rigid platform includes two downwardly-extending lateral portions, each portion terminating in a snap-on, semi-circular foot, the rigid platform being directly and rigidly connected to the frame by direct engagement between the frame and a respective snap-on, semi-circular foot of the rigid platform.

In another feature of the collapsible, inflatable or inflated floatation board of this invention, the frame is a two-section, separated, longitudinally-extending spine extending along the center line of the floatation board; the platform includes two downwardly-curved, lateral portions and a central, depending, longitudinally-extending rib; the floatation member is in contact with the downwardly-curved lateral portions of the rigid platform and the central, depending, longitudinally-extending rib; and the rigid platform is directly and rigidly connected to the central, depending, longitudinally-extending rib.

In one feature of the inflatable or inflated sailboard of this invention, the floatation portion includes a frame which is the same peripheral frame as described above for the floatation board.

In another feature of the inflatable or inflated sailboard of this invention, the floatation portion includes a frame which is the same two-section separated, longitudinally-extending spine as described above for the floatation board.

BRIEF DESCRIPTION OF THE DRAWINGS

In the accompanying drawings.

Figure 1:
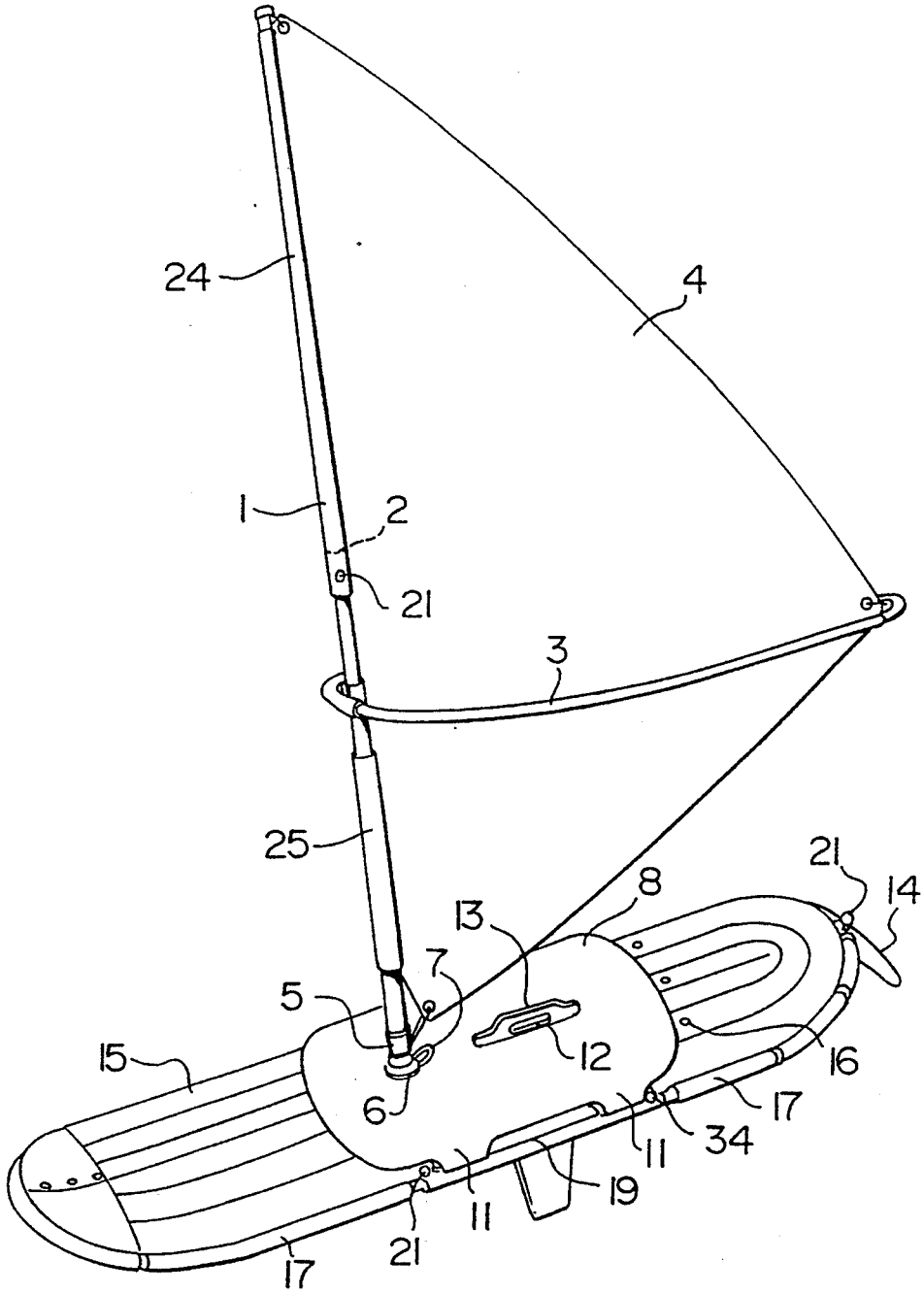
FIG. 1 is a perspective view of one embodiment of the sailboard of this invention.
Figure 2:
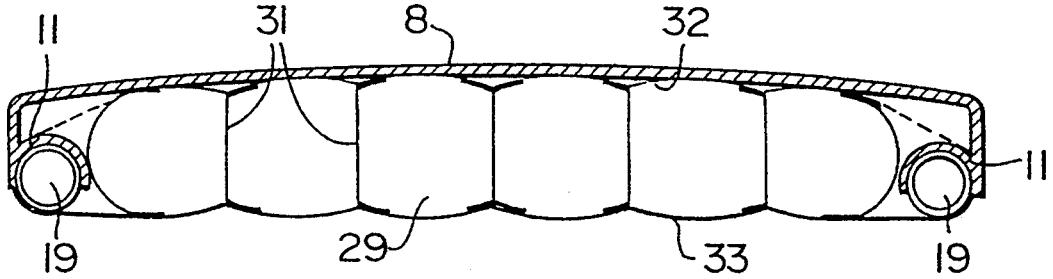
FIG. 2 is a typical transverse cross-section of one embodiment of the sailboard shown in FIG. 1.

DESCRIPTION OF THE PREFERRED EMBODIMENTS (i) Description of FIGS. 1 and 2

The main body of the collapsible, inflatable or inflated, rigid floatation board of this invention is comprised of three components: a platform or standing surface (8), an air bag section (15), and a rigid frame (19). The platform (8) supports the mast (1), and the removable centre board keel (13), and provides standing surface for the user. The platform (8) is rigid in nature, and is positioned on top of the air bag section (15). The platform (8) has a socket therein to accept the mast (1) and a slot to accept the removable centre board keel (13). The platform (8) allows room for walking around the mast area. The underside of the platform (8) is supported by a rigid peripheral frame (19) by means of snap-on semi-circular-in-cross-section feet (11) into which the rigid peripheral frame (19) is inserted. The rigid frame (19) then becomes integral with the platform (8).

As seen in FIG. 2, the air bag section (15) is comprised of at least three air chambers with six being shown, the outer ones being designated (29), with at least three separate valves (16). The air bag section (15) contains a minimum of five internal walls (31) which connect the top surface/skin (32) to the bottom surface/skin (33). The air bag section (15) is supported by the rigid frame (19) by means of sleeves (17) around the outside periphery of the air bag body (15).

The rigid frame (19) completes the collapsible, inflatable or inflated, rigid floatation board of this invention, by adding the required rigidity. A range of rigidity is provided by a peripheral frame (19) in four sections, which completely surrounds the air bag body (15). The frame joints (34) between vicinal frame members (19), which are connected in the conventional manner known to those skilled in the art, are secured together through cotter pins (21) in the conventional manner known to those skilled in the art. The skeg (14) is connected to the stern section of the peripheral rigid frame (19). This connection can be secured by means of a cotter pin (21) in the conventional manner to those skilled in the art.

Figure 3:
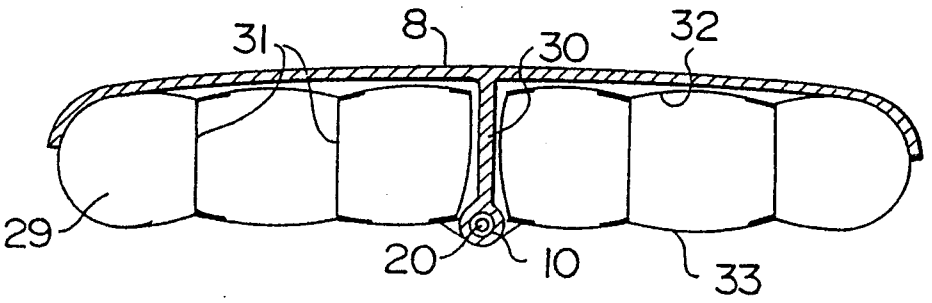
FIG. 3 is a typical transverse cross-section of a second embodiment of the sailboard shown in FIG. 1.
Figure 4:
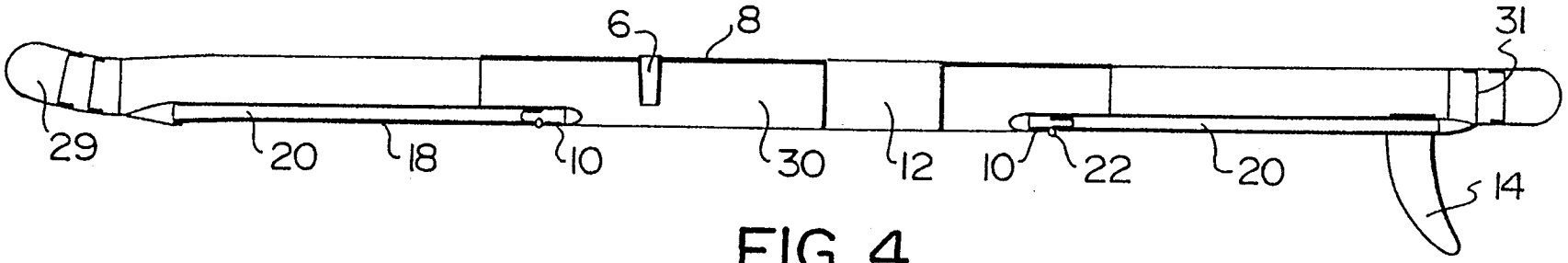
FIG. 4 is a central longitudinal section through the sailboard of FIG. 1.

(ii) Description of FIGS. 3 and 4

As was previously described with respect to FIGS. 1 and 2, the main body of the collapsible, inflatable or inflated, rigid floatation board of this invention is comprised of three components, namely: a platform or rigid standing surface (8), an air bag section (15) and a rigid frame (20). The platform (8) supports the mast (1), and the vertically-movable center board keel (13) and provides a standing surface for the user. The platform (8) is rigid in nature, and is positioned on top of the air bag section (15). The platform (8) has a socket (6) to accept the mast (1) and a slot (12) to accept the removable center board keel (13). The platform (8) allows room for walking around the mast area. The underside of the platform (8) is supported by a rigid, two-piece, separated, longitudinally-extending frame (20). Platform (8) is provided with a central, depending, longitudinally-extending rib (30) which embraces frames (20) by means of socket (10). In addition, the platform (8) includes lateral arcuate dependent members (40) which rest on the outer surfaces (41) of the outer air chambers (29) of the air bag section (15).

As seen in FIG. 3, the air bag section (15) is composed of six air chambers, the outer air chambers being designated (29). As was seen previously in FIG. 1, three separate valves are provided. As seen in FIG. 3, the air bag section (15) contains six internal walls (31) which connect the top surface/skin (32) to the bottom surface/skin (33). The air bag section (15) is supported by the rigid frame (20) by means of sleeves (18) on the underside of the air bag section (15) at the socket (10).

The rigid frame (20) completes the collapsible, inflatable or inflated, rigid floatation board of this invention by adding the required rigidity. A range of rigidity is provided, as indicated before, by the two-part frame (20) which provides a spine along the length of the air bag section (15) down the center line. The skeg (14) is connected to the stern section in a manner known to those skilled in the art.

Figure 5:
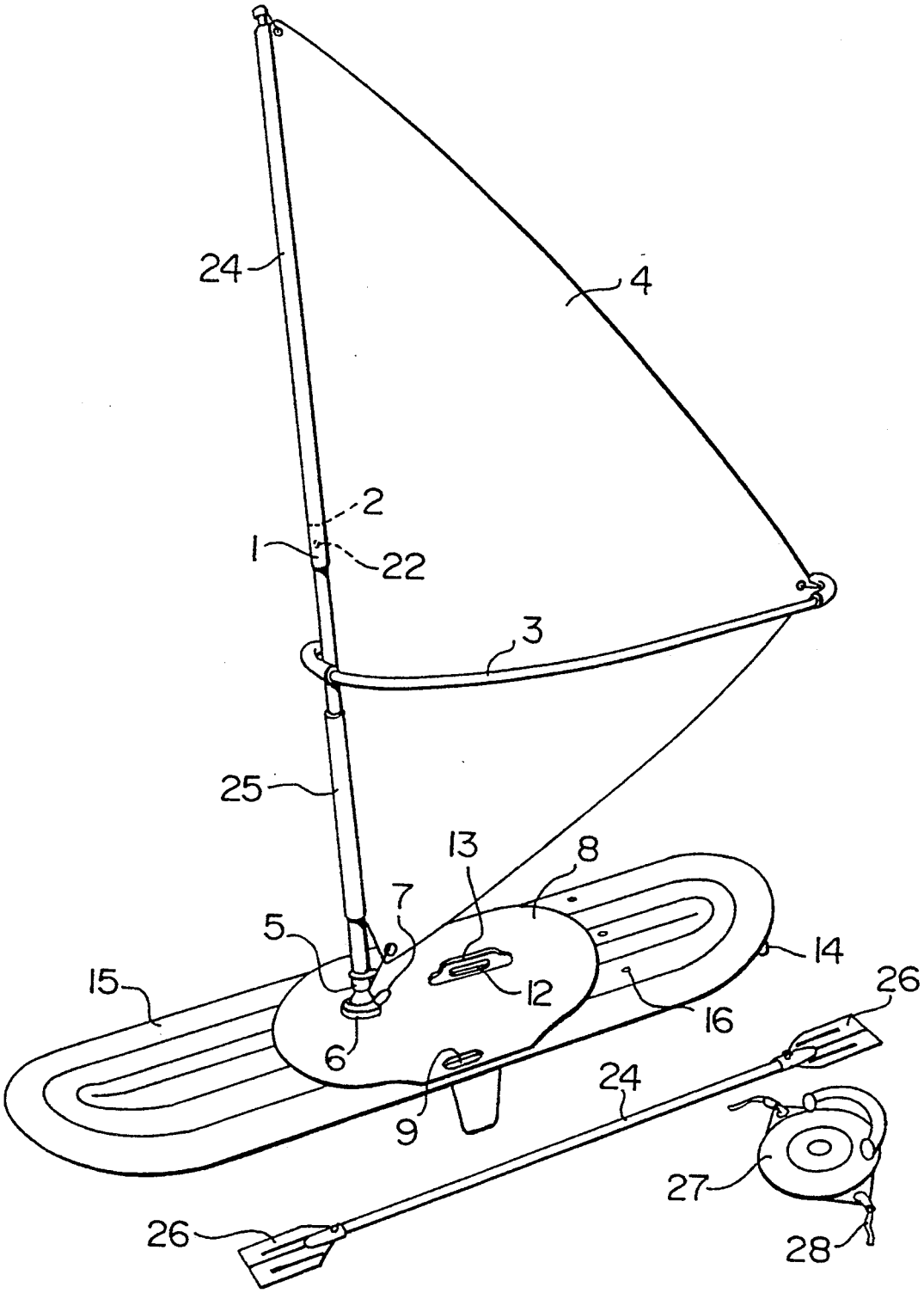
FIG. 5 is a perspective view of another embodiment of this invention.

(iii) Description of FIG. 5

Secondary functions/uses for the invention include: being used as a kayak/paddle board, surf board, floating platform, and air mattress. To be used as a kayak/paddle board, the wishbone rig (1),(3),(4), is removed and the board portion (15,8) used with other accessories. These include two kayak paddle blades (26) and an inflatable seat (27). The upper portion (24) of the mast (1) is disassembled, and the two kayak paddle blades (26) are fitted to each of it's ends, secured in place by cotter pins (21) or by spring-mounted buttons (22). The inflatable seat (27) is positioned on the top of the platform (8), and secured by straps (28).

As a surf board, the board (15,8) is used alone, with the user standing on the platform (8). The invention is used in the same way as a floating platform.

(iv) Generalized Description

An existing child's wishbone rig is used with the collapsible, inflatable or inflated, rigid floatation board of this invention. This is to be composed of a child's mast (1) (approximately 12 feet tall), a child's wishbone boom (3) (approximately 6 feet long), and a standard 3.5 $m^2$ sail (4). A standard universal joint (5) (of the flexible hourglass or tendon type) is used to attach the mast (1) to the platform (8) at socket (6). A modification to the standard mast (1) is required to allow it to be transported as two separate 6 foot lengths. This modification involves a flush joint (2) at the half way mark, using an inner tube to reinforce it, and either a spring-mounted button (22), (see FIG. 5) or a cotter pin (21), (see FIG. 1) to secure it.

Conclusion

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A collapsible, inflatable or inflated, rigid floatation board comprising:

(i) a floatation member comprising a plurality of discrete, gas-fillable or gas-filled, elongated chambers, each said chamber having a top skin and a bottom skin, each said chamber, when inflated, being sufficiently rigid to maintain its shape without any additional support, and to provide a flat bottom surface for contact with water, said chambers being integrally united to provide an elongated float which is of greater length than width;

(ii) a longitudinally-extending, supporting and stiffening rigid peripheral frame comprising a plurality of interconnected tubular members, interconnected with each other in a longitudinal direction, said rigid peripheral frame being adapted to support said floatation member and to provide additional stiffness and resistance to fore-and-aft bending and torsion; and (iii) a rigid platform, which is of the same width as said floatation member but which is of less length, said rigid platform including two downwardly-extending lateral portions, each portion terminating in a snap-on, semi-circular foot, said rigid platform being directly and rigidly connected to said frame by direct engagement between said frame and a respective snap-on, semi-circular foot of said rigid platform, so that said rigid platform is firmly held to the top skin of said floatation member and is directly and rigidly connected to said rigid longitudinal frame;

whereby said gas-fillable floatation member, when filled with gas, said rigid frame, and said rigid platform together provide an integral, unitary assembly which imparts additional rigidity to said flat bottom surface of said flotation member and also imparts stiffness in a transverse direction to said flotation member.

2. A collapsible, inflatable or inflated, rigid floatation board comprising:

(i) a floatation member comprising a plurality of discrete, gas-fillable or gas-filled, elongated chambers, each said chamber having a top skin and a bottom skin, each said chamber, when inflated, being sufficiently rigid to maintain its shape without any additional support, and to provide a flat bottom surface for contact with water, said chambers being integrally united to provide an elongated float which is of greater length than width;

(ii) a longitudinally-extending, supporting and stiffening rigid frame, wherein said frame is a two-section, separated, longitudinally-extending spine extending along the center of said flotation member said spine comprising a plurality of frame sections which are interconnectable with each other in a longitudinal direction, said rigid frame being adapted to support said floatation member and to provide additional stiffness and resistance to fore-and aft bending and torsion; and (iii) a rigid platform, which is of the same width as said floatation member but which is of less length;

said platform including two downwardly-curved, lateral portions and a central, depending, longitudinally-extending rib, said rigid platform being directly and rigidly connected to said central, depending, longitudinally-extending rib; said floatation member being in contact with said downwardly-curved lateral portions of said platform and adjacent to said central, depending, longitudinally-extending rib, so that said rigid platform is firmly held to the top skin of said floatation member and is directly and rigidly connected to said rigid longitudinal frame; whereby said gas-fillable flotation member, when filled with gas, said rigid frame and said rigid platform together provide an integral, unitary assembly which imparts additional rigidity to said flat bottom surface of said floatation member and also imparts stiffness in a transverse direction to said floatation member.

3. An inflatable, or inflated sailboard comprising the combination of:

(A) a floating portion comprising:

(i) a floatation member comprising a plurality of discrete, gas-fillable or gas-filled, elongated chambers, each said chamber having a top skin and a bottom skin, each said chamber, when inflated, being sufficiently rigid to maintain its shape without any additional support, and to provide a flat bottom surface for contact with water, said chambers being integrally united to provide an elongated float which is of greater length than width;

(ii) a longitudinally-extending, supporting and stiffening rigid peripheral frame comprising a plurality of interconnected tubular members, interconnected with each other in a longitudinal direction, said rigid peripheral frame being adapted to support said floatation member and to provide additional stiffness and resistance to fore-and-aft bending and torsion; and (iii) a rigid platform, which is of the same width as said floatation member but which is of less length, said rigid platform including two downwardly-extending lateral portions, each portion terminating in a snap-on, semi-circular foot, said rigid platform being directly and rigidly connected to said frame by direct engagement between said frame and a respective snap-on, semi-circular foot of said rigid platform, so that said rigid platform is firmly held to the top skin of said floatation member and is directly and rigidly connected to said rigid longitudinal frame;

(iv) a skeg secured to the stern end of said frame; and (v) a removable center board keel supported by said platform; and (B) a mast and a sail unit comprising a mast including a plurality of interlocking mast sections, a wishbone boom, a sail, means for attaching said sail to said mast, and a universal joint secured to said platform for attaching said mast to said platform;

whereby said assembly of said floatation member, when gas-filled, said rigid frame and said rigid platform together provide an integral rigid unit which imparts additional rigidity to said floatation member and also imparts stiffness in a transverse direction to said floatation member, thereby to provide an inflated sailboard having longitudinal torsional strength and where there is direct and rigid transmission of forces evenly and rigidly from the water and through the integral rigid unit, to the user.

4. An inflatable, or inflated sailboard comprising the combination of:

(A) a floating portion comprising:

(i) a floatation member comprising a plurality of discrete, gas-fillable or gas-filled, elongated chambers, each said chamber having a top skin and a bottom skin, each said chamber, when inflated, being sufficiently rigid to maintain its shape without any additional support, and to provide a flat bottom surface for contact with water, said chambers being integrally united to provide an elongated float which is of greater length than width;

(ii) a longitudinally-extending, supporting and stiffening rigid frame, wherein said frame is a two-section, separated, longitudinally-extending spine extending along the center of said flotation member said spine comprising a plurality of frame sections which are interconnectable with each other in a longitudinal direction, said rigid frame being adapted to support said floatation member and to provide additional stiffness and resistance to fore-and-aft bending and torsion; and (iii) a rigid platform, which is of the same width as said floatation member but which is of less length said platform including two downwardly-curved, lateral portions and a central, depending, longitudinally-extending rib, said rigid platform being directly and rigidly connected to said central, depending, longitudinally-extending rib;

(iv) a skeg secured to the stern end of said frame; and (v) a removable center board keel supported by said platform; and (B) a mast and sail unit comprising a mast including a plurality of interlocking mast sections, a wishbone boom including a plurality of interlocking boom sections, a sail, means for attaching said sail to said mast, and a universal joint secured to said platform for attaching said mast to said platform;

whereby said assembly of said floatation member, when gas-filled, said rigid frame and said rigid platform together provide an integral rigid unit which imparts additional rigidity to said floatation member and also imparts stiffness in a transverse direction to said floatation member, thereby to provide an inflated sailboard having longitudinal torsional strength and where there is direct and rigid transmission of forces evenly and rigidly from the water and through the integral rigid unit, to the user.

* * * * *